US006571594B2

(12) United States Patent
Clark

(10) Patent No.: US 6,571,594 B2
(45) Date of Patent: Jun. 3, 2003

(54) OPEN BACK BRAKE

(75) Inventor: Michael C. Clark, Columbiaville, MI (US)

(73) Assignee: Tapco International, Inc., Plymouth, MI (US)

( * ) Notice: Subject to any disclaimer, the term of this patent is extended or adjusted under 35 U.S.C. 154(b) by 0 days.

(21) Appl. No.: 10/003,025

(22) Filed: Nov. 2, 2001

(65) Prior Publication Data

US 2003/0084698 A1 May 8, 2003

(51) Int. Cl.[7] ..... B21D 11/00
(52) U.S. Cl. ..... 72/319
(58) Field of Search ..... 72/319, 320, 387, 72/389.3

(56) References Cited

U.S. PATENT DOCUMENTS

| | | | | | |
|---|---|---|---|---|---|
| 480,396 | A | * | 8/1892 | Clark | 72/31.11 |
| 3,147,791 | A | * | 9/1964 | Rauen et al. | 72/319 |
| 3,380,280 | A | * | 4/1968 | Wise | 72/319 |
| 3,481,174 | A | | 12/1969 | Barnack | 72/319 |
| 3,482,427 | A | | 12/1969 | Barnack | 72/319 |
| 3,559,444 | A | | 2/1971 | Blazey et al. | 72/319 |
| 3,730,116 | A | | 5/1973 | Schramayr | 112/121.15 |
| 3,817,075 | A | | 6/1974 | Marsh et al. | 72/319 |
| 4,081,986 | A | | 4/1978 | Break | 72/320 |
| 4,092,841 | A | | 6/1978 | Chambers, Jr. | 72/320 |
| 4,116,034 | A | | 9/1978 | Ruediger | 72/387 |
| 4,237,716 | A | | 12/1980 | Onisko | 72/319 |
| 4,240,279 | A | | 12/1980 | Rhoades | 72/319 |
| 4,282,735 | A | | 8/1981 | Break | 72/319 |
| 4,321,817 | A | | 3/1982 | Barnack | 72/319 |
| 4,364,254 | A | | 12/1982 | Chubb et al. | 72/319 |
| 4,383,430 | A | | 5/1983 | Klaus | 72/387 |
| 4,445,356 | A | | 5/1984 | Chubb et al. | 72/319 |
| 4,494,397 | A | | 1/1985 | Rhoades | 72/320 |
| 4,557,132 | A | * | 12/1985 | Break | 72/319 |
| 4,671,094 | A | | 6/1987 | Break | 72/319 |
| 4,766,757 | A | | 8/1988 | Break et al. | 72/319 |
| 4,984,833 | A | | 1/1991 | Knürr | 292/96 |
| 5,239,853 | A | | 8/1993 | Kutschker | 72/319 |
| 5,343,728 | A | | 9/1994 | Chubb et al. | 72/319 |
| 5,353,620 | A | | 10/1994 | Olsen et al. | 72/319 |
| 5,505,069 | A | | 4/1996 | Break et al. | 72/319 |
| 5,582,053 | A | | 12/1996 | Chubb et al. | 72/294 |
| 5,582,055 | A | | 12/1996 | Chubb et al. | 72/319 |
| 5,706,692 | A | | 1/1998 | Chubb et al. | 72/294 |
| 5,743,129 | A | | 4/1998 | Chubb et al. | 72/319 |
| 5,846,038 | A | | 12/1998 | Bostelman | 410/154 |
| 5,899,000 | A | | 5/1999 | Break et al. | 30/240 |
| 5,941,621 | A | | 8/1999 | Boulay et al. | 312/334.4 |
| 6,038,909 | A | | 3/2000 | Zink | 72/319 |
| 6,085,569 | A | * | 7/2000 | Chubb et al. | 72/319 |

* cited by examiner

*Primary Examiner*—Lowell A. Larson
*Assistant Examiner*—John S. Goetz
(74) *Attorney, Agent, or Firm*—Howard & Howard

(57) ABSTRACT

A sheet bending brake for forming a workpiece comprises a base and an anvil having a bottom-clamping surface. The anvil is positioned in a fixed spaced relationship above the base and in combination with the base defines an unobstructed passage therebetween for receiving at least a portion of the workpiece. A movable plate is disposed between the base and the top plate wherein the movable plate is vertically translatable therein for clamping the workpiece between a top surface of the movable plate and the bottom clamping surface. A bending member is pivotally attached to the movable plate and extends longitudinally therealong for bending the clamped workpiece.

10 Claims, 4 Drawing Sheets

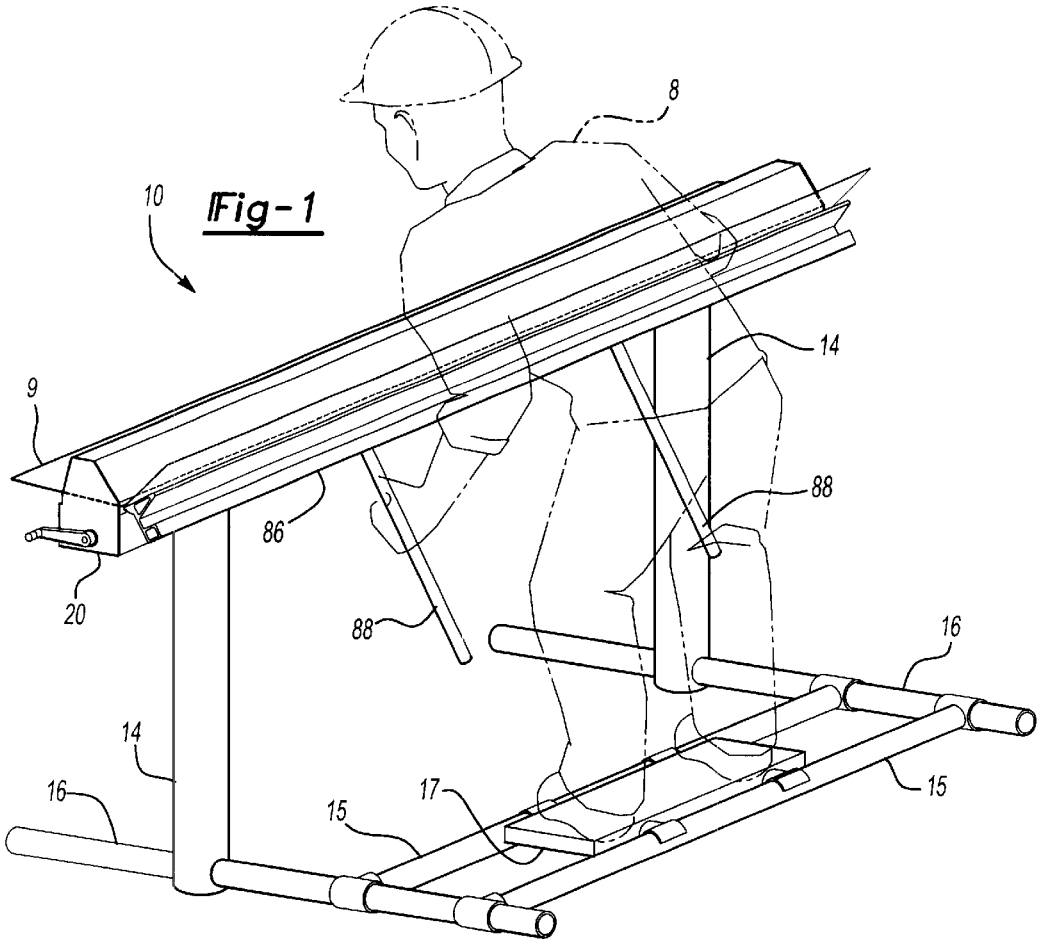
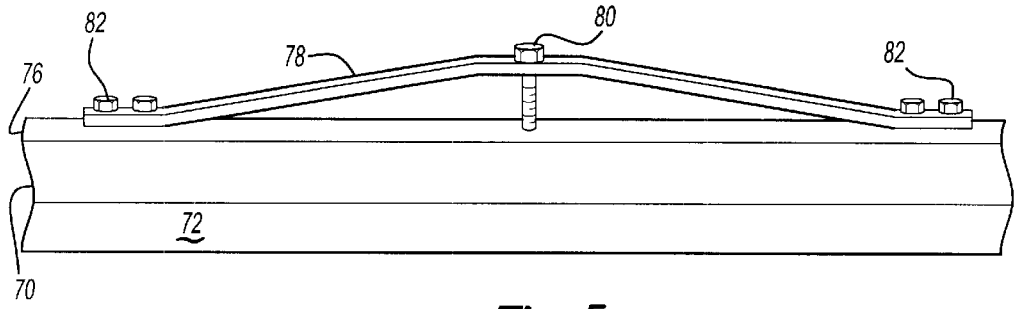
Fig-5

OPEN BACK BRAKE

FIELD OF THE INVENTION

This invention relates to brakes for bending sheet material, and in particular to a portable sheet bending brake for bending metal or plastic sheets such as are used in siding on homes and buildings.

BACKGROUND OF THE INVENTION

Stationary brakes for making angular bends in sections of sheet metal generally employ a pair of jaws and a bending arm hinged to one of the jaws. Such brakes are operative to engage an extending section of the sheet metal work piece clamped between the jaws and have long been used in shops for forming sheet metal in various applications. In recent years smaller portable, lightweight brakes have been developed that may be used in the field by workmen to custom form sections of sheet metal in such applications as duct work in the home, aluminum siding for the home, etc. These brakes have typically employed a number of spaced C-shaped frame members joined together by rails. A fixed work clamping surface extends along one end of each of the frames, and a movable work clamping surface is supported on the other edge of the frames. The movable work clamping surface is moved toward and away from the fixed surface for clamping workpiece therebetween with one of the frame member arms.

The arms of the C-shaped frame members are movable with respect to each other by pivoting about a common point or are pivoted with respect to each other by some arrangement of linkage. These C-frame structures suffer from the disadvantage wherein after repeated use, the actuating mechanisms for the movable clamp wear and loosen. This results in misalignment between the bending edge of the movable clamp surface with respect to the bending member. The C-frame members are also relatively heavy, expensive to form, and susceptible to breakage at their throats. Additionally, the C-shaped members by reason of being spaced along the length of the brake limit the extent to which the workpiece can be extended through the back of the brake. The depth of the throat of the C-shaped section defines the limit of the workpiece extension.

Thus, it is desirable to have a brake wherein the workpiece can extend a significant distance through the back of the brake and more preferably wherein the back of the brake is unobstructed to provide the brake with optimum versatility. However, when C-shaped members are utilized, the only way to accomplish this is by utilizing C-shaped members having extremely long throats. As the length of the throat increases the propensity of the brake members to become misaligned or having the C-members fracture at the throat increases correspondingly.

Thus, there is a need within the industry for a portable brake wherein a workpiece can be extended through the back, yet be simple and sturdy to construct, with little propensity to become misaligned after repeated use.

SUMMARY OF THE INVENTION AND ADVANTAGES

One aspect of the present invention is a sheet bending brake assembly comprising a base with first and second ends. An anvil is supported in a vertically spaced distance from the base and is aligned with the base between the first and second ends. A hinge plate is mounted to the base and extends longitudinally between the first and second ends. A bending member is pivotally attached to the hinge plate for bending a workpiece clamped between the hinge plate and the anvil. The assembly is further characterized by a mechanism movably supporting the hinge plate and for moving the hinge plate toward the anvil to clamp the workpiece therebetween.

Another aspect of the present invention is a sheet bending brake for forming a workpiece wherein the brake comprises a base and an anvil having a bottom-clamping surface. The anvil is positioned in a fixed spaced relationship above the base and in combination with the base defines an unobstructed passage therebetween for receiving at least a portion of the workpiece. A movable plate is disposed between the base and the top plate wherein the movable plate is vertically translatable therein for clamping the workpiece between a top surface of the movable plate and the bottom clamping surface. A bending member is pivotally attached to the movable plate and extends longitudinally therealong for bending the clamped workpiece.

Yet another aspect of the present invention is a method of clamping an article of sheet material in a sheet bending brake wherein the sheet bending brake is of the type having a base and an anvil in a fixed space relationship above the base defining a passage therebetween. A movable plate is positioned in the passage and is vertically translatable therein, and a cam bar is interposed between the base and the movable plate wherein the movable plate and the cam bar have opposing cooperative cam surfaces. The method comprises the steps of placing the article of sheet material between the movable plate and the anvil and then translating the cam bar in a horizontal direction. The horizontal translation of the cam bar causes the opposing cam surfaces to translate one against the other thus causing the movable plate to rise as a result of the translation of the cam surfaces one against the other. Sufficient horizontal force is applied on the cam bar to firmly clamp the workpiece between the anvil and the movable plate.

The present invention provides a portable sheet bending brake that includes an open back to allow sheets of indefinite length to be formed.

These and other advantages of the invention will be further understood and appreciated by those skilled in the art by reference to the following written specification, claims and appended drawings.

BRIEF DESCRIPTION OF THE DRAWINGS

Other advantages of the present invention will be readily appreciated as the same becomes better understood by reference to the following detailed description when considered in connection with the accompanying drawings wherein:

FIG. 1 is a perspective view of an open back brake embodying the present invention, showing an operator forming a piece of sheet metal therein.

FIG. 5 is a plan view of the brace attached to the brake anvil.

DETAILED DESCRIPTION OF THE PREFERRED EMBODIMENT

For purposes of description herein, the terms "upper," "lower," "right," "left," "rear," "front," "vertical,"

Figure 4:
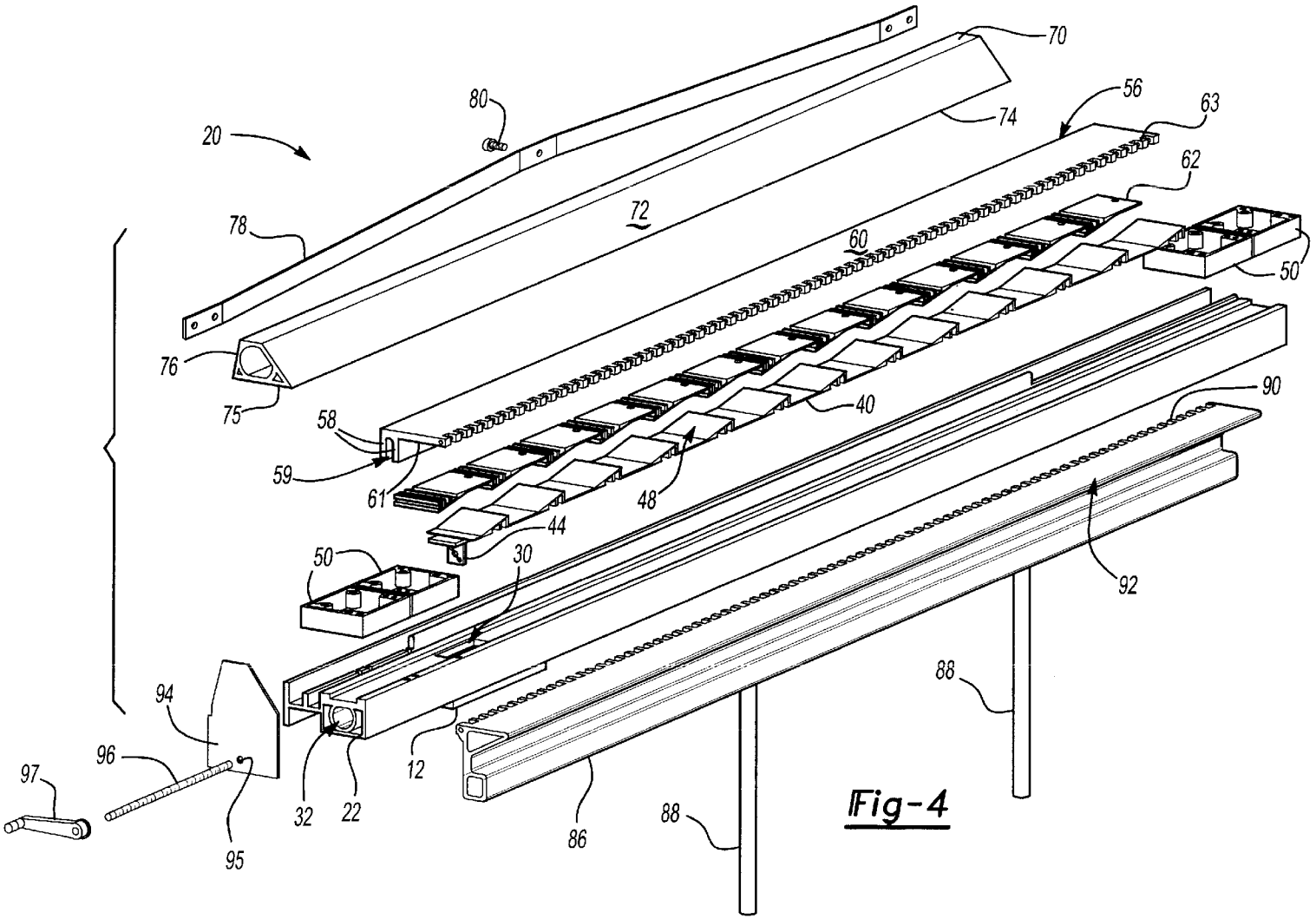
FIG. 4 is an exploded, perspective view of the open back brake embodying the resent invention.

"horizontal," and derivatives thereof shall relate to the invention as oriented in FIG. 4. However, it is to be understood that the invention may assume various orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Turning to the drawings, FIGS. 1–5 show an open back brake 20, which is one of the preferred embodiments of the present invention, and illustrates its various components.

Referring to FIG. 1, a portable brake 10 is shown wherein a sheet bending brake assembly 20 having an open back is mounted on and supported above the ground at a working level by a pair of leg assemblies 14. Each leg assembly 14 includes a mount 12 (FIG. 3) affixed to a top there of. In the preferred embodiment, mount 12 is a section of an extrusion having a pair of legs 13 extending upwardly at a rear portion thereof. Open back brake 20 is affixed to mount 12 using fasteners (not shown) that facilitate easy assembly and disassembly of portable brake 10. A rail 16 is attached to each leg assembly 14 wherein rails 16 extend from leg assemblies 14 toward the operator 8 of the brake. A pair of crossbars 15 extends between rails 16 at an end most proximate to the operator and supports a centrally located platform 17 therebetween. When an operator 8 desires to bend a workpiece 9 in brake 20, he stands on platform 17. Operator 8 bends workpiece 9 by grasping handles 88 and pivots bending member 86 upwardly. As a result of standing on platform 17, the operator's weight counteracts the moment induced on brake 10 by the bending resistance of the workpiece 9 being formed.

Figure 2:
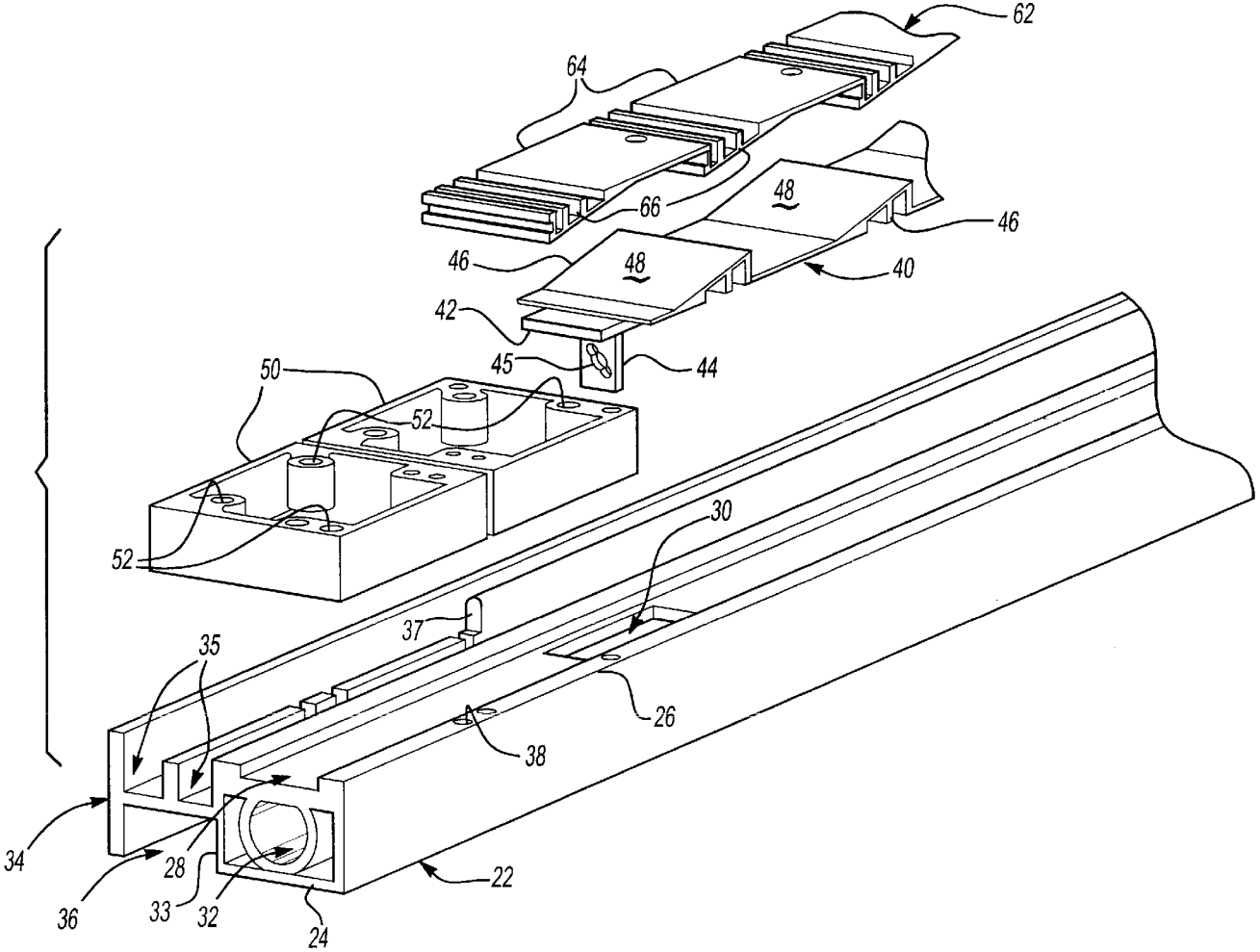
FIG. 2 is an exploded view of the left end of the open back brake shown in FIG. 1.
Figure 3:
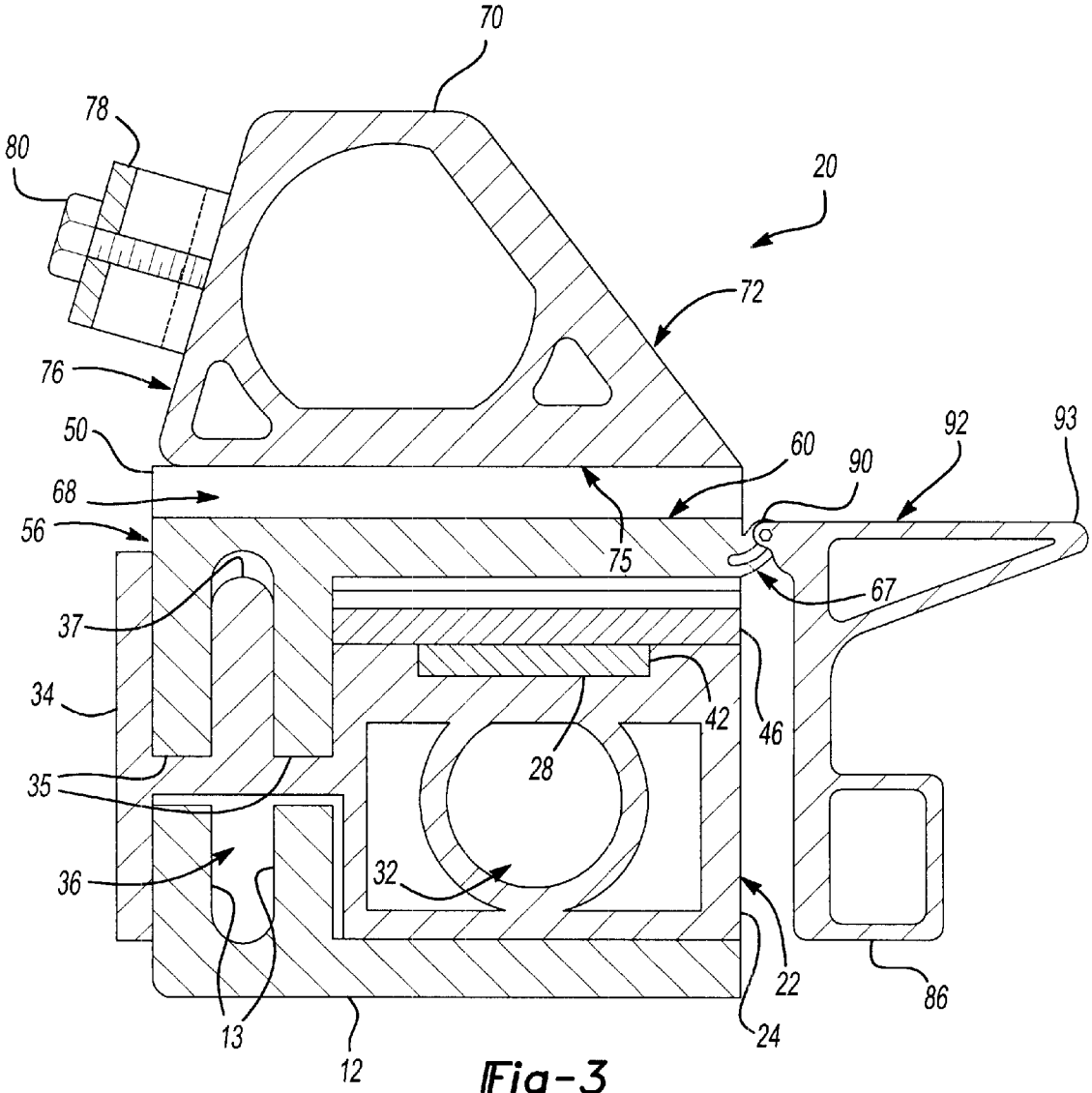
FIG. 3 is a vertical cross-sectional view of the brake shown in FIG. 1 with a workpiece clamped therein.

Turning to FIGS. 2–5, and most particularly to the exploded view in FIG. 4, open back brake 20 comprises a base 22 here shown as an extrusion. Where possible the preferred embodiment incorporates the use of aluminum extrusions to save weight and promote the portability of brake assembly 10. However, those skilled in the art will readily recognize that other suitable structures and assemblies that incorporate the below-described features can be substituted for the shown extrusions without departing from the intent of the disclosure. As more clearly shown in FIGS. 2–3, base 22 comprises a body 24 having a top surface 26 that defines a channel 28 extending the length of base 22. Body 24 further defines a chamber 32 that extends longitudinally within body 24 from its leftmost end at least to aperture 30. Aperture 30 extends through the bottom of channel 28 and communicates with chamber 32. In the preferred embodiment, aperture 30 is rectilinear and has a longitudinal length to accommodate the movement of arm 44 therein as described in more detail below. A modified H-section structure extends rearward from back 33 of body 24, and defines a bottom channel 36 and two rear channels 35 separated by flange 37. As shown in FIG. 3, bottom channel 36 receives upward extending legs 13 of mount 12.

A cam bar 40 comprises a plurality of wedge elements 46 affixed to a top surface of bar 42. Bar 42 has a width and height corresponding to channel 28 such that bar 42 can readily translate along the longitudinal axis of channel 28. Bar 42 further includes an arm 44 depending from its left end and is positioned such that arm 44 is received in aperture 30 of base 22 and extends into chamber 32. In the preferred embodiment, wedge elements 46 are formed from sections of an extrusion and are arranged in an end-to-end manner such that inclined cam surfaces 48 of each wedge element 46 are oriented in the same direction and face upward away from base 22. Wedge elements 46 can be affixed to bar 42 by welding, mechanical fasteners, or alternatively, inclined cam faces can be integrally formed on the upper surface of a bar 42 having a substantially greater thickness than shown. Those skilled in the art will also recognize that other methods of forming cam bar 40 are possible.

A pair of spacer blocks 50 abut the top surface 26 of base 22 such that holes 52 and spacer blocks 50 are aligned with holes 38 in base 22. As illustrated in the preferred embodiment, spacers 50 are formed from sections of a common extrusion; however, a single larger spacer could also be implemented in place of two smaller spacers 50 as shown herein. Cam bar 40 is of a shorter length than the space between the spacers 50 at the left end of base 22 and the spacers 50 at the right end of base 22. Thus, cam bar 40 can be longitudinally translated in channel 28 between left and right spacers 50.

A movable hinge plate 56 is disposed above cam bar 40 and extends between spacers 50 at the left and right ends of base 22. Hinge plate 56 includes at a back portion thereof a pair of downwardly depending legs 58 that define a slot 59 therebetween. Each of legs 58 are received in one of rear channels 35 of base 22 and flange 37 of base 22 is received in slot 59 thereby permitting hinge plate 56 to move vertically with respect to base 22 while maintaining hinge plate 56 in a substantially horizontal orientation with respect to the fixed elements of brake 20. Hinge plate 56 has a cam strip 62 affixed to bottom surface 61. In the preferred embodiment, cam strip 62 is comprised of a plurality of upper wedge elements 64 each having a cam surface 66. Upper wedge elements 64 are substantially identical to wedge elements 46 on cam bar 40 and are arranged in an inverted and oppositely facing manner from wedge elements 46 such that cam surfaces 66 of upper wedge elements 64 face cam surfaces 48 of wedge elements 46.

A top anvil 70 has a sloped front face 72, which in combination with anvil bottom surface 75 defines anvil edge 74. Top anvil 70 rests on spacers 50 in such a manner that upper plate surface 60 of hinge plate 56 and bottom surface 75 of anvil 70 are parallel and define an unobstructed passageway 68 therebetween for clamping a workpiece 9 therebetween. Top anvil 70, spacer blocks 50, and base 22 are rigidly attached one to the other by bolts (not shown) extending through holes 38 of base 22 and holes 52 of spacer blocks 50 and threaded into holes (not shown) in anvil 70. In the preferred embodiment, anvil 70 is also formed from an extrusion. A brace strap 78 extending substantially the length of anvil 70 is attached at both ends to a back face 76 of anvil 70 with fasteners 82. A bolt 80 is received in a threaded hole at a midpoint of brace strap 78 and is threaded therein. As bolt 80 is threaded through the hole, the threaded end of bolt 80 bears upon rear face 76 of anvil 70 thus drawing the midpoint of strap 78 away from anvil 70. This arrangement forms a triangular relationship between brace strap 78 and anvil 70 thus adding extra rigidity to anvil 70 to counteract the forces imparted to anvil 70 when a workpiece 9 is being formed therein.

A bending member 86 is pivotally attached to a front edge of hinge plate 56 for bending a workpiece that is clamped between hinge plate 56 and anvil 70. Hinge plate 56 includes a hinge segment 63 at a front edge thereof. Hinge segment 63 comprises a plurality of tangs which, intermesh with a like arrangement of hinge tangs on a mating hinge segment 90 of bending member 86. The two hinge segments 63 and 90 are maintained in a pivotal relationship by a hinge pin (not shown). The hinge tangs of hinge segment 63 on hinge plate 56 include slots 67. Slots 67 in hinge plate 56 are oriented such that as bending member 86 is pivoted relative to hinge plate 56 to bend a workpiece, the hinge pin is guided along slots 67. By so guiding the hinge pin, a contact area 93 of bearing surface 92 remains substantially in the same position relative to workpiece 9 during the bending operation. The aforementioned described hinge construction is substantially as shown in U.S. Pat. No. 4,557,132, herein incorporated by reference. A pair of handles 88 are affixed to and extend from bending member 86 to aid the operator in pivoting bending member 86 with respect to hinge plate 56 and to supply the requisite force to the workpiece to permanently deform it in a desired manner.

As shown in FIG. 4, an end plate 94 is affixed to the left end of base 22, spacer 50 and anvil 70, and generally conforms to the elevational profile thereof. End plate 94 includes an aperture 95 substantially in axial alignment with chamber 32 in base 22. A threaded rod 96 has a handle 97 attached to one end thereof and has an opposite end extending through aperture 95 into chamber 32 and threaded into threaded hole 45 in arm 44 extending into chamber 32 through aperture 30. Threaded rod 96 is retained by end plate 94 in a manner permitting the rotation of threaded rod with respect to end plate 94 but retaining threaded rod 96 in a fixed longitudinal relationship thereto.

In operation, handle 97 is rotated to translate cam bar 40 to its rightmost position which, as a result of the orientation of lower cam surfaces 48 with respect to upper cam surfaces 66, results in eliminating the contact between cam surfaces 48 and 66. In this position, hinge plate 56 is at its lowermost position thereby maximizing the vertical dimension of passageway 68. A workpiece 9 to be formed is inserted in passageway 68 between upper surface 60 of hinge plate 56 and bottom surface 75 of anvil 70 such that the desired bend line of workpiece 9 is properly aligned with anvil edge 74 for producing the desired bend. Handle 97 is then rotated and through its threaded engagement with threaded hole 45 in arm 44 translates cam bar 40 to the left. As cam bar 40 is translated leftward, cam surfaces 48 bear upon and slide upon cam surfaces 66 of cam strip 62 thereby causing hinge plate 56 to rise vertically. Since legs 58 of hinge plate 56 are closely received in rear channels 35 of base 22, upper surface 60 of hinge plate 56 remains substantially parallel to lower surface 75 of anvil 70. Handle 97 is rotated until hinge plate 56 has risen to firmly clamp workpiece 9 between hinge plate 56 and anvil 70. Operator 8 then stands on platform 17 to stabilize portable brake 10 and to prevent it from rotating backwards while the workpiece 9 is formed.

To form workpiece 9, the operator grasps handles 88 with his hands and pivots bending member 86 with respect to hinge plate 56. As bending member 86 is pivoted, contact area 93 comes in bears against a bottom surface of workpiece 10. The continued pivoting of bending member 86 further causes workpiece 9 to be bent along its length at anvil edge 74. Since hinge plate 56 is securely clamped against workpiece 9 and top anvil 70 and legs 58 are closely received in rear channels 35, hinge plate 56 is prevented from pivoting with respect to anvil 70 thereby maintaining a desired alignment therebetween.

When workpiece 9 is formed as desired, handle 97 is then rotated in an opposite direction to translate cam bar 40 to the right thereby lowering hinge plate 56 with respect to anvil 70 and thus releasing workpiece 9 from between hinge plate surface 60 and bottom surface 75 of anvil 70. Since anvil 70 is held stationary and maintained rigid as a result of its construction configuration and brace 78, the requirement for C-sections at intermediate positions along the length of brake 20 as found in conventional brakes is eliminated. Thus, the back of brake 20 is open and unobstructed, and any length of workpiece 9 can extend from the back of brake 20 with no interference or obstruction by any of the structure of brake 20.

In the foregoing description, those skilled in the art will readily appreciate that modifications may be made to the invention without departing from the concepts disclosed herein. Such modifications are to be considered as included in the following claims, unless these claims expressly state otherwise.

I claim:

1. A sheet bending brake assembly comprising:

a base with first and second ends, the base having a top surface and a channel formed therein, the base further include an aperture within the channel and a chamber extending longitudinally within the base from one of the first and second ends to at least the aperture;

an anvil supported at a vertically spaced distance from said base and aligned with said base between said first and second ends;

a hinge plate disposed above said base and extending longitudinally between said first and second ends;

a pair of spacer blocks abutting the top surface of the base, the spacer blocks forming a space above the channel;

a cam bar having a length shorter than the space formed by the spacer blocks, the cam bar being slidably disposed within the channel, the cam bar also including an arm extending therefrom and being inserted within the aperture;

a plurality of lower wedge elements connected to and slidable with the cam bar, each lower wedge element having a cam surface;

a cam strip having a top surface in contact with a bottom surface of the hinge plate, the cam strip having a plurality of upper wedge elements, each upper wedge element corresponding to a respective lower wedge element of the cam bar, each upper wedge element having a cam surface slidably in contact with the cam surface of the respective lower wedge element;

a bending member pivotally attached to said hinge plate for bending a workpiece clamped between said hinge plate and said anvil; and a threaded rod inserted through the chamber in the base and being threadably coupled to the arm, wherein rotation of the threaded rod in one direction slides the cam bar within the channel thereby moving said hinge plate toward said anvil to clamp the workpiece therebetween.

2. The assembly according to claim 1 wherein the spacer blocks vertically support said anvil in said spaced distance from said base.

3. The assembly according to claim 1 further including a support brace mounted to and extending longitudinally of said anvil to prevent said anvil from flexing under load to maintain a consistent clamping force over an entire length of said hinge plate.

4. The assembly according to claim 3 wherein said support brace includes a center and ends, said center having a greater vertical height than said ends.

5. The sheet bending brake according to claim 1 wherein said hinge plate and said bending member include longitudinally spaced intermeshing integral hinge portions extending along the entire length of said hinge plate and said bending member.

6. The sheet bending brake according to claim 5 wherein said hinge portions include a plurality of aligned openings, said openings on said hinge portion of said hinge plate being slots extending axially with respect to the longitudinal axis of said hinge plate.

7. The sheet bending brake according to claim 6 including a hinge pin extending through said slots of said hinge plate and said openings of said bending member for pivotally connecting said bending member to said hinge plate.

8. The sheet bending brake according to claim 6 wherein said slots have a configuration such that as the bending member is pivoted relative to said hinge plate to bend a workpiece, the hinge pin is guided along said slots such that the contacting portion of said bending member remains substantially in the same position relative to the workpiece during the bending operation.

9. The sheet bending brake according to claim 1 including a handle coupled with said bending member for selectively and manually moving said bending member, the handle member being accessible from a first side of the assembly such that a user manually manipulates the handle member in a generally arcuate motion to exert a generally upward force to bend the work piece.

10. The sheet bending brake according to claim 1 including a stand supporting said sheet bending brake above a ground surface including at least two spaced legs and an extension associated with each leg extending out from beneath said stand and at least one cross member extending between said extensions such that the user standing on the cross member provides a counteractive force to the upward bending force to stabilize said sheet bending brake and prevent said sheet bending brake from tipping away from the operator during the bending operation.

* * * * *